United States Patent [19]

Nakayama et al.

[11] 4,003,680

[45] Jan. 18, 1977

[54] SWASH-PLATE COMPRESSOR

[75] Inventors: Shozo Nakayama; Kimio Kato, both of Kariya; Sigeru Suzuki, Nishio, all of Japan

[73] Assignee: Kabushiki Kaisha Toyoda Jidoshokki Seisakusho, Kariya, Japan

[22] Filed: Apr. 22, 1975

[21] Appl. No.: 570,317

[30] Foreign Application Priority Data

May 15, 1974 Japan ..... 49-55977

[52] U.S. Cl. ..... 417/269; 184/6.17; 417/439

[51] Int. Cl.[2] ..... F04B 1/12; F01M 1/00; F04B 21/00

[58] Field of Search ..... 417/269, 439; 184/6.17

[56] References Cited

UNITED STATES PATENTS

| | | | |
|---|---|---|---|
| 1,731,774 | 10/1929 | Gurley | 417/439 |
| 2,835,436 | 5/1958 | Steinhagen et al. | 417/439 |
| 3,712,759 | 1/1973 | Olson | 417/269 |
| 3,801,227 | 4/1974 | Nakayama | 417/269 |
| 3,838,942 | 10/1974 | Pokorny | 417/269 |

*Primary Examiner*—Carlton R. Croyle
*Assistant Examiner*—G. P. LaPointe
*Attorney, Agent, or Firm*—Sughrue, Rothwell, Mion, Zinn & Macpeak

[57] ABSTRACT

A swash-plate type compressor is provided with an improved internal arrangement for lubricating internal moving elements, such as bearings, pistons and shoes wherein a passage is provided for introducing a foam of the lubrication oil, which was generated in the reservoir at the moment of starting the compressor, into the swash-plate chamber and the cylinder bores for lubricating the internal moving elements. The improved internal arrangement further contributes to effective employment of the blow-by refrigerant gas for the distribution of lubrication oil to the bearings and the cylinder bores.

1 Claim, 2 Drawing Figures

SWASH-PLATE COMPRESSOR

FIELD OF THE INVENTION

The present invention relates to a swash-plate type compressor and, more particularly, to an internal arrangement for distributing oil lubricant to the bearings and the multipistons in a swash-plate type compressor which is used in air conditioning systems for vehicles.

BACKGROUND OF THE INVENTION

U.S. Pat. No. 3,801,227 of Shozo Nakayama discloses a multi-piston, double acting, single swash-plate refrigerant gas compressor having a pair of horizontal axially aligned cylinder blocks forming a combined block.

The compressors of this type are provided with an internal arrangement for distributing oil lubricant to movable parts or elements of such compressors, such as pistons, bearings and shoes in contact with the swash-plate. However, it has recently been found that such a prior internal arrangement is incomplete for the following reason.

When the compressor is stopped, lubrication oil flows into the reservoir by gravity and moving elements become dry. Also the refrigerant gas has no suspended oil particles therein. At the moment of starting the compressor, said dry gas is sucked into the compressor, and passes over the surfaces of said moving elements without any lubricating thereof, so they are susceptible to damage due to overheating.

OBJECT OF THE INVENTION

It is therefore an object of the present invention to provide an improved compressor.

Another object is the provision of a swash-plate type compressor having an improved internal lubricating arrangement to prevent overheating of the moving elements especially during the starting period.

A further object is to provide such a compressor wherein the blow-by refrigerant gas is employed for the distribution of lubricating oil to the bearings and the cylinder bores.

SUMMARY OF THE INVENTION

These objects are attained in the present invention by the provision of a fluid conduit to introduce a foam of lubrication oil with and the conduit so arranged that it communicates at one end with the reservoir at a position higher than the level of lubrication oil stored in the reservoir, and at the other end at right angles to the flow of the refrigerant gas passing through the inlet port.

DESCRIPTION OF THE DRAWING

The above and other objects, features and advantages of the present invention will be more readily understood from the following description with reference to a preferred embodiment as shown in the accompanying drawing in which.

DETAILED DESCRIPTION OF THE INVENTION

Figure 1:
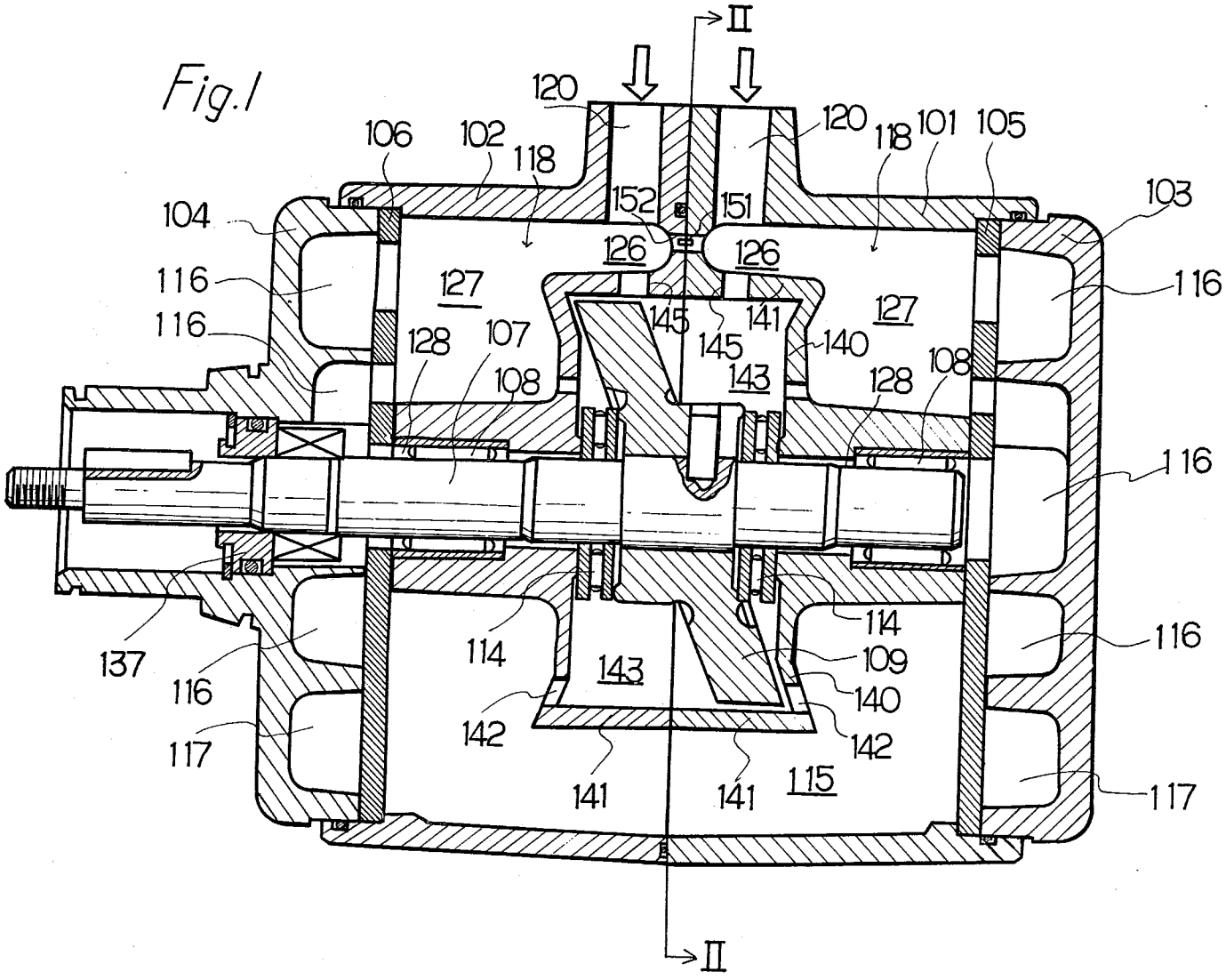
FIG. 1 is a longitudinal cross sectional view of a swash-plate type compressor according to one embodiment of the present invention.
Figure 2:
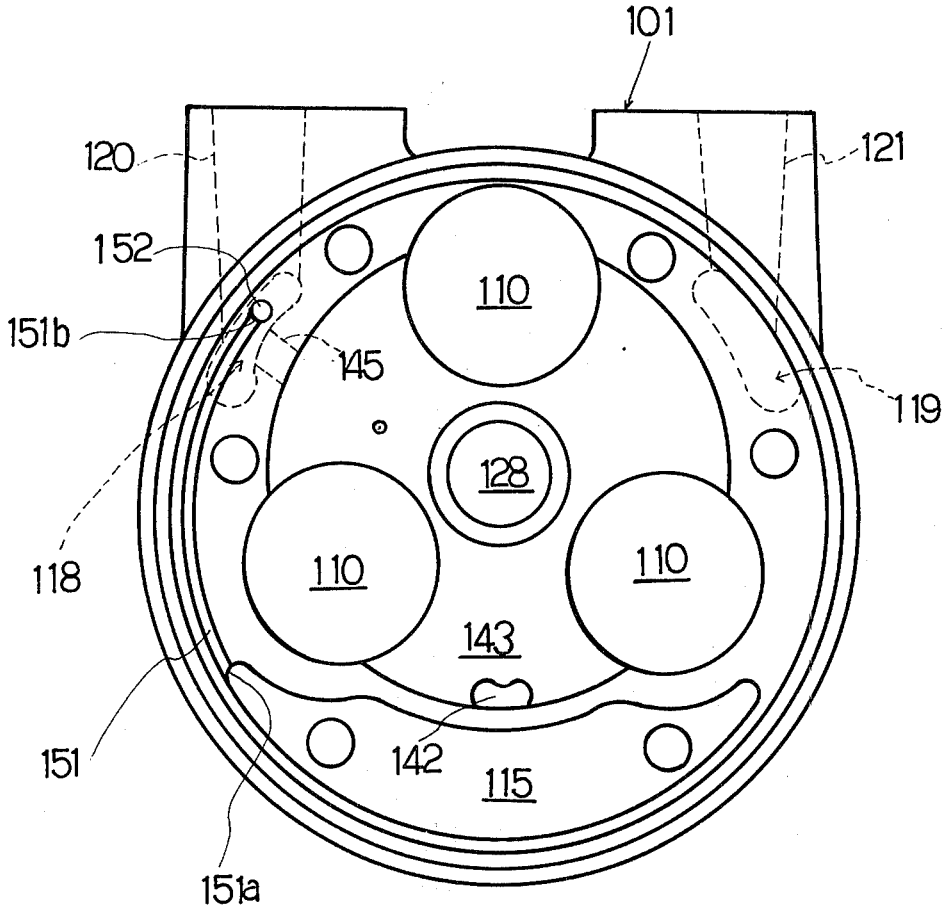
FIG. 2 is a front view of one of the cylinder blocks, taken in the direction of the arrows along the line 11—11 of FIG. 1.

Referring to FIGS. 1 and 2, the compressor has a pair of cylinder blocks, i.e. a front cylinder block 102 and a rear cylinder block 101, combined with each other in an axial alignment. Each cylinder block is provided with three axially extending cylinder bores 110 arranged in parallel with each other. Each cylinder block is also provided with a suction passageway 118, discharge passageway 119, a lubricant reservoir 115, a centrally arranged swash-plate chamber 143 and a shaft bore 128. The swash-plate chamber 143 is defined by a pair of side plates 140 for connecting the neighbouring bore walls and three pairs of partition walls 141 which extend from the side plates 140 towards the junction of the both cylinder blocks 101, 102. The passageways 118, 119 and the lubricant reservoir 115 are formed in the spaces enclosed by the neighbouring cylinder bores 110 and the outer wall of the cylinder block. The combined block is further accompanied by a pair of front and rear cylinder heads 104 and 103 attached to the front and rear cylinder blocks 102 and 101, respectively, via respective valve plates 106 and 105.

Coaxially passing through the blocks, heads and plates, a drive shaft 107 provides a direct connection with a drive part (not shown) of the drive engine of the vehicle and is rotatably mounted by needle bearings 108 provided at the outer ends of the blocks 101 and 102. Near the junction of both blocks 101 and 102, this drive shaft 107 is provided with a swash-plate 109 keyed thereon. In the cylinder bores 110 double acting pistons (not shown) are slidably inserted and engaged with both faces of the swash-plate 109 via balls and shoes of conventional structure. Due to this engagement, rotation of the swash-plate 109 causes reciprocal sliding of the pistons within the bores 110. A pair of thrust bearings 114 are disposed between the boss of the swash-plate 109 and the blocks 101 and 102 so as to assume the axial thrust load caused by the pumping action of the pistons.

The passageways 118 and 119 are closed near the junction of the blocks 101, 102 and are in communication with inlet ports 120 or outlet ports 121 opening at the outer ends of the cylinder blocks 101 and 102. After circulation through the refrigerating circuit, the refrigerant returns to the compressor and is led into the inlet ports 120 and is distributed equally to the refrigerant passageways 118 formed in both cylinder blocks 101 and 102. The refrigerant passageway 118 is made up of a smaller part 126 of a smaller transverse cross sectional area and a larger part 127 of a larger transverse cross sectional area communicating directly with the smaller part 126. Passing through the inlet port 120, the refrigerant is introduced into the smaller parts 126 and is forced to change its direction of flow when it strikes the outer surface of the partition walls 141. The partition walls 141 of the swash-plate chamber 143 are provided with through-holes 145 for permitting a position of the oil particles suspended in the refrigerant gas introduced from the inlet ports 120 to directly flow into the swash-plate chamber 143 through said holes 145 due to the inertia of the stream of the refrigerant gas. Therefore the through-holes 145 are arranged to be nearly in alignment with inlet ports 120.

Upon introduction into the larger parts 127, the refrigerant flow is suddenly decelerated due to the sudden increase in the transverse cross sectional area and oil particles of larger weight are separated from their associated refrigerant flow under the force of gravity. The oil content separated from its associated refrigerant and accumulated at the bottom of the larger part 127 is led into the shaftbore 128 through the suction chamber 116 and is distributed towards a sealing member 137, the needle bearings 108, etc. for lubrication thereof.

After passing through the larger parts 127, the refrigerant gas is conducted into the suction chambers 116 of both heads 103, 104 through the valve plates 105, 106 located at the outward extension of the larger parts 127. The refrigerant is then sucked into the cylinder bores 110 by operation of a suitable suction valve (not shown), and the remaining oil content adheres on the surface of the cylinder bores to lubricate them.

The compressed refrigerant is then discharged into the discharge chambers 117 of the heads 103, 104 via dischage valves (not shown), then into the refrigerant passageways 119 and finally towards the outlet ports 121.

At the joining surface of the both cylinder blocks 101, 102, each cylinder block is provided with an arc-shaped groove 151. The grooves 151 are aligned face to face and form a fluid conduit which communicates at one end 151*a* with the lubricant reservoir 115 at a location above the level of lubrication oil stored in the reservoir 115 and at the other end 151*b* with the smaller portions 126 via openings 152 disposed at right angles to the flow of the refrigerant gas from the inlet ports 120.

When the compressor is not operated, the pressure of the refrigerant system is averaged at a substantial value, and some volume of the refrigerant gas is absorbed into the lubricant under the averaged pressure. At the time of starting of the compressor, the pressure of the lubricant reservoir communicated with the inlet ports 120 via the grooves 151 is reduced, and foaming of the lubrication oil is generated in the lubricant reservoir 115. As the openings 152 are directed at right angles with the flow of the refrigerant gas from the inlet ports 120, the foam generated in the lubricant reservoir 115 is sucked into the refrigerant flow at the inlet portion not only by the static pressure but also the dynamic pressure. Thus the refrigerant gas gets suspended oil particles and lubricates the moving elements.

After the excess of refrigerant gas which is absorbed in the lubrication the reservoir 115 has evaporated, the foaming phenomenon is settled, and the supplying the refrigerant gas with lubricant oil through the openings 152 ceases since the end 151*a* of the groove 151 opens at a location above the level of lubrication oil stored in the reservoir 115. Therefore, when the compressor is in the condition of continuous operation and the refrigerant gas sucked into the compressor has some volume of suspended oil particles, the refrigerant gas is prevented from receiving excessive lubricant oil which would exert a bad influence upon the volumetric efficiency of the compressor.

The side plates 140 separating the swash-plate chamber 143 from the reservoir 115 have apertures 142, through which the blow-by refrigerant gas in the swash-plate chamber 143 is sucked into the smaller parts 126 via the grooves 151. Then oil particles suspended in the blow-by refrigerant gas lubricate the sealing member 137, the needle bearings 108 and the cylinder bores 110 as aforementioned.

In the foregoing description, the present invention is made apparent with reference to the one embodiment which is constructed on the basis of the swash-plate type compressor of the type disclosed in the U.S. Pat. No. 3,801,227.

What is claimed is:

1. In a swash-plate type compressor of the type having a pair of horizontal axially aligned cylinder blocks forming a combined block which is provided with an inlet port in each block for introducing a refrigerant gas having oil particles suspended therein from the exterior of the compressor into each block, a pair of oil separating passageways communicating with each port respectively and extending in opposite axial directions of the combined block for separating the oil particles from the introduced refrigerant gas, means defining a lubricating oil reservoir and a swash-plate chamber in the middle portion of said combined block for rotatably supporting a swash-plate which is mounted on a drive shaft and causes reciprocal motions of compressor pistons slidably retained in aligned cylinder bores of said combined block, a pair of cylinder heads positioned at opposite ends of said combined block, each said head having a suction chamber connected to each of said oil passageways and valve plates interposed between said cylinder heads and said cylinder blocks, the improvement comprising a single fluid conduit for communicating each of said inlet ports with said lubricating oil reservoir, one end of said fluid conduit opening into the top of said reservoir above the level of lubrication oil stored in said reservoir and the other end of said fluid conduit is provided with oppositely directed ports each of which meets at right angles with the flow of refrigerant gas from each inlet port respectively whereby foaming lubricating oil generated in said reservoir upon starting said compressor is sucked into said refrigerant gas passing through said inlet ports, said fluid conduit being a groove located at the joining surface of said cylinder blocks.

* * * * *